United States Patent [19]

Ambal

[11] Patent Number: 4,683,611

[45] Date of Patent: Aug. 4, 1987

[54] LOCKING FOOT FOR SECUREMENT TO SUPPORT

[75] Inventor: Gilbert Ambal, Frepillon, France

[73] Assignee: ITW de France, D.A., Beauchamp, France

[21] Appl. No.: 776,308

[22] Filed: Sep. 16, 1985

[30] Foreign Application Priority Data

Sep. 21, 1984 [FR] France ..... 84 14528

[51] Int. Cl.[4] ..... A44B 17/00

[52] U.S. Cl. ..... 16/225; 24/297; 24/453; 403/406.1

[58] Field of Search ..... 16/225; 403/406.1, 405.1; 24/621, 622, 457, 453, 573, 598, 597, 297; 248/677, 188.8, 188.9, 345.1

[56] References Cited

U.S. PATENT DOCUMENTS 4,517,711 5/1985 Tanaka ..... 24/453

4,579,478 4/1986 Takahashi ..... 403/406.1

*Primary Examiner*—E. R. Kazenske

*Assistant Examiner*—James L. Wolfe

*Attorney, Agent, or Firm*—John P. O'Brien; Thomas W. Buckman

[57] ABSTRACT

A securement foot is lockable to a support of any kind. It comprises a base formed with a longitudinal stop, two lateral stops and a transverse stop, with another transverse stop being provided on an element hinged to the base, said hinged element carrying a portion of the locking means, with the other portion thereof being integral with the base. The support is for example a hook, a holding clip, and the like.

2 Claims, 5 Drawing Figures

LOCKING FOOT FOR SECUREMENT TO SUPPORT

This invention relates to a securement foot with locking means adapted to be locked to any support.

The advantage of this invention is to provide a locking foot which can be readily mounted without any significant effort. When it is in the locked position its tear off strength is very high. Its bulk is very small since it projects very little as compared to conventional feet which have insufficient hold when they project very little.

In accordance with this invention the securement foot with locking means for fixation into an opening formed in any support comprises a base having a longitudinal stop thereon, two lateral stops and a transverse stop, another transverse stop being provided on a member hinged to the base and also providing a longitudinal stop, said hinged member carrying a portion of said locking means which is in two parts, with the other portion being integral with the base.

Other characteristics and advantages of this invention will appear from the following description of exemplifying forms of embodiment with reference to the attached drawings in which.

Figure 2:
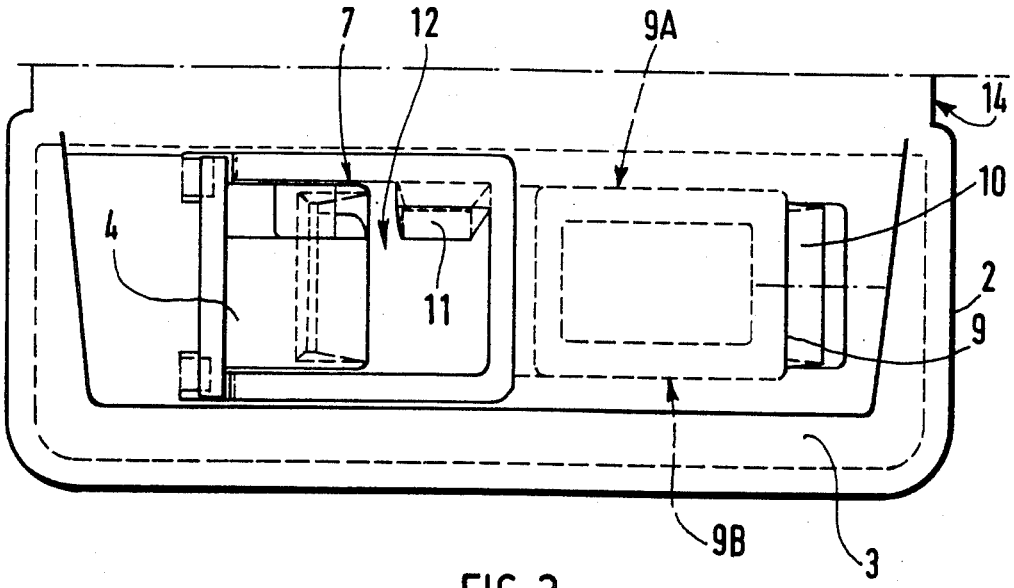
FIG. 2 is a plane view.
Figure 1:
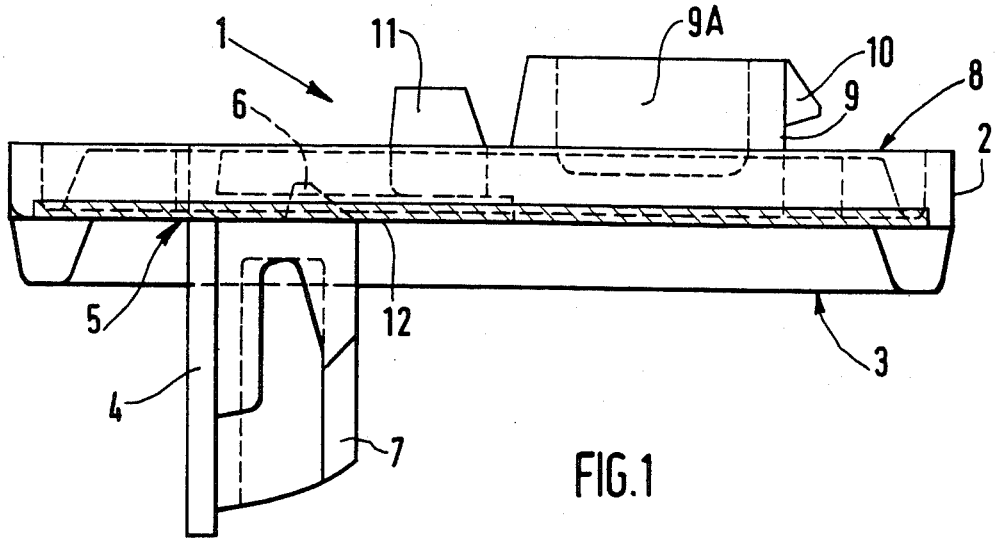
FIG. 1 is an elevational view of a securement foot according to the invention in a form of embodiment wherein identical feet are coupled hingedly.

In the form of embodiment shown the invention equips a hinge of thermoplastic material which comprises two securement feet, with one on each portion of the hinge thereby showing an example wherein minimum bulks "x" in thickness behind the supports should be provided.

Each securement foot 1 comprises a base 2 on a face 3 of which a movable shoe 4 is connected through a hinge 5. The shoe 4 is provided with a retaining lug 6 as well as a blocking tooth 7.

The base 2 comprises on its other face 8 a fixed shoe 9 forming a longitudinal stop provided with retaining lug 10.

There is also implanted into the base 2 an elastic blade 11 for blocking the movable shoe 4. Such blade protrudes through a window 12 formed in the base and in which the movable shoe 4 can move.

Figure 4:
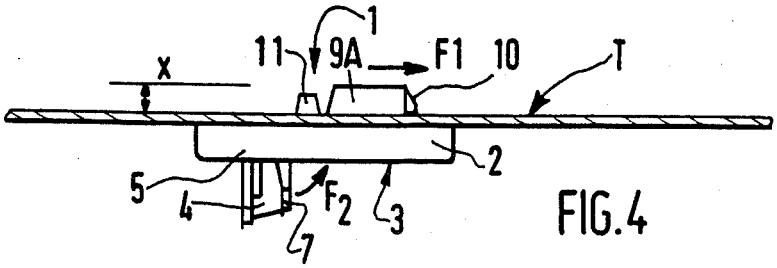
FIG. 4 is an elevational view to explain the operation.

During the mounting (FIG. 4) in a first step the foot 1 is presented through the intermediary of the fixed shoe 9 into an opening E preferably a rectangular one of a support of any kind T and is slipped longitudinally into the opening so that the lug 10 comes behind the support (arrow F1) with the shoe 9 forming a longitudinal stop.

In a second step a push is exerted onto the shoe 4 which pivots (arrow F2) about its hinge 5. The lug 6 of such shoe moves to place itself behind the support. During the pivoting motion of the shoe 4 the elastic blade 11 flexes through the tooth 7.

At the end of travel the elastic blade 11 releases itself behind the tooth 7 thereby locking the shoe 4.

At this time the foot becomes locked and no longitudinal movement can occur.

Figure 3:
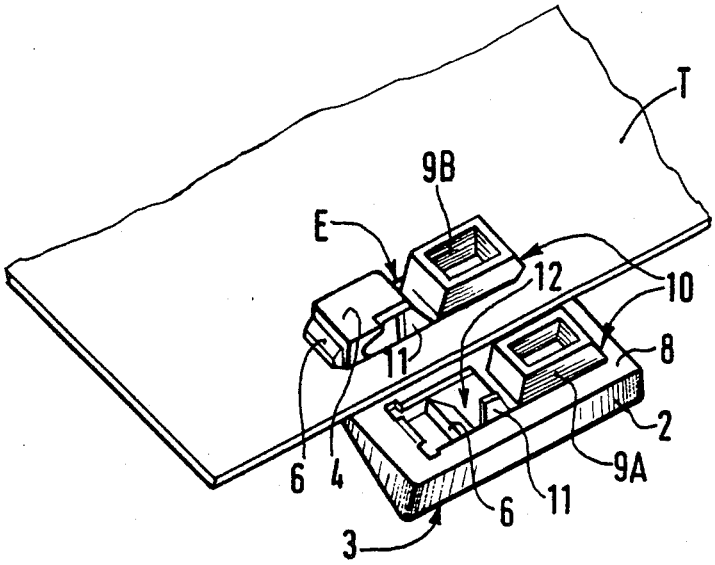
FIG. 3 is a perspective view wherein one of the feet is mounted to a support.

Both lugs or transverse stops 10 and 6 emprison and lock the foot to the support (FIG. 3).

Moreover, due to the facets 9A and 9B forming lateral stops for the fixed shoe 9 any lateral moves are prevented.

Such system is very flat and this is significant in certain cases of mounting such as in the form of embodiment having the hinge.

Figure 5:
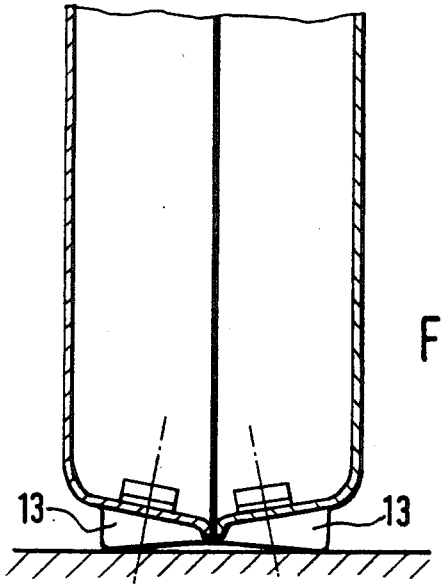
FIG. 5 is a partial cross-sectional view of a box equipped with a hinge according to the invention.

Furthermore, in the application thereof to a box hinge both hinge bases can be designed so that when the hinge is closed it is used as a base 13 (FIG. 5) so as to be able to make a box stand; such box can be a case or other element and this is very advantageous in use.

Obviously, the feet 1 are twinned so as to form a hinge (hinge 14) in the form of embodiment represented but the invention is also intended for supplying a single foot 1 (therefore without hinge) suitable for other applications such as for example the application consisting of a foot having a face 3 used for implantation of any element such as hook, holding clip means, and the like.

It will be understood finally that this invention was only described and represented in a preferential exemplifying form of embodiment and that equivalent elements can be substituted for its constituents without however departing from the scope of the invention as required in the appended claims.

I claim:

1. A one piece plastic push-in fastener for securement within an aperture of a workpiece comprising:

a base member having top and bottom sides and a particular shaped aperture proximate one longitudinal end thereof; and a resilient retaining means for affixing said fastener to said workpiece having a resilient retaining member integrally hinged to said bottom side of said base proximate a wall of said aperture whereby said retaining member is rotated about said hinge through said aperture to said top side of said base to enable said retaining member to retain said fastener within said aperture of said workpiece, and said top side of said base including an upstanding integral locking pin for engagement with said retaining member to prevent said retaining member from being rotated back through said particular shaped aperture to said bottom side of said base and to provide necessary retention forces.

2. A one-piece plastic push-in fastener for securement within an aperture of a workpiece comprising:

a base member having top and bottom sides and a particular shaped aperture proximate one longitudinal end thereof; and a resilient retaining means for affixing said fastener to said workpiece having first and second retaining members, said first retaining member being integral with said base on said top side of said base proximate the end of said base opposite said particular shaped aperture, and said second retaining member being integrally hinged to said bottom side of said base proximate a wall of said aperture whereby said second retaining member is rotated about said hinge through said aperture to said top side of said base to enable both of said first and second retaining members to cooperate to retain said fastener within said aperture of said workpiece, and said top side of said base including an upstanding integral locking pin for engagement with said second retaining member to prevent said second retaining member from being rotated back through said particular shaped aperture to said bottom side of said base and to provide necessary retention forces.

* * * * *